US006386207B2

(12) United States Patent
Stewart

(10) Patent No.: US 6,386,207 B2
(45) **Date of Patent: *May 14, 2002**

(54) HAIR DEVICE

(75) Inventor: Frances Todd Stewart, 1227 Wightman St., Pittsburgh, PA (US) 15217

(73) Assignee: Frances Todd Stewart, Pittsburgh, PA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/492,587

(22) Filed: Jan. 27, 2000

Related U.S. Application Data

(60) Provisional application No. 60/117,897, filed on Jan. 29, 1999.

(51) Int. Cl.[7] ..... A45D 8/12
(52) U.S. Cl. ..... 132/275
(58) Field of Search ..... 132/275, 246, 132/247; D28/39, 41; 446/374

(56) References Cited

U.S. PATENT DOCUMENTS 1,364,861 A * 1/1921 Koch ..... 446/374
1,552,618 A * 9/1925 Klemm, Jr. ..... 132/246
3,019,552 A * 2/1962 Schleich ..... 446/374
4,197,358 A * 4/1980 Garcia ..... 446/374
5,097,854 A * 3/1992 Smith ..... 132/275
5,115,825 A * 5/1992 Kuhn ..... 132/275
5,664,589 A * 9/1997 Black ..... 132/246
5,713,218 A * 2/1998 McCabe ..... 132/275

FOREIGN PATENT DOCUMENTS

JP 3089109 * 4/1988 ..... 132/246

* cited by examiner

*Primary Examiner*—Todd E. Manahan

(57) ABSTRACT

A hair devise is used to decorate hair or to hold hair in fixed position. The hair device includes a bendable wire encased in plastic for bending around the hair. The wire is encased in two or more appendages per side extending from a central body. The configuration of the devise may stimulate a character or animal. The appendages grip the hair by simulating prongs that clamp around the hair instead of performing as a continuous wrap or band. This structure reduces the risk of breaking the hair when applying and removing from the head. Multiple appendages also facilitate application by the person by gripping the hair in more than one place thus securing the attachment sooner than in wrapping a single strand. Specific weights and measurements are important to the function of this devise.

4 Claims, 5 Drawing Sheets

HAIR DEVICE

CROSS REFERENCE TO RELATED APPLICATIONS

This application claims the benefit of copending U.S. Provisional Application No. 60/117,897, filed Jan. 29, 1999, by the same inventor.

BACKGROUND OF THE INVENTION

The present invention relates to hair devices, and more particularly to a hair device either that can be secured in the hair or that secures hair in a fixed position.

It is oftentimes desirable to secure hair into a certain style using various devices, which may also be decorative and fashionable in appearance. It is well known in the art to use hair devices to secure hair into a fixed position, or as decoration in the hair, or as a combination of both function and decoration. Hair holding devices that are also decorative in nature are particularly attractive to children.

There are many different devices and articles that are used to hold the hair in a desired style. However, oftentimes hair holding devices are harsh and damaging to the hair of children which tends to be more fragile than the hair of adults. Oftentimes hair holding devices are made of some form of elastic material which is stretched and twisted securely around the hair to hold the hair into a fixed position. However, the elastic material often tends to tangle within the hair and may break-off strands of hair as the hair holding device is secured to or removed from the hair.

Additionally, metal or plastic "barrette" type devices are also used to secure hair into a desired position while also providing a decorative fashion accessory for the hair. However, metal "barrette" type devices tend to cause strands of hair to "break-off" in the area in which they are tightly secured, and are particularly harsh to fine hair strands. While plastic "barrette" type devices are not as harsh and damaging to individual hair strands, they oftentimes become tangled within the hair and damage hair strands when the "barrette" type devices are secured around an area of hair that is too thick for the "barrette" device. In this case, individual strands of hair are often pulled and broken-off when the plastic "barrette" type devices are "snapped" and secured into place, because the fastening ends of the "barrettes" inevitably fasten with unwanted strands of hair being secured directly between the two fastening ends of the "barrette" type device.

SUMMARY OF THE INVENTION

The present invention substantially departs from the conventional concepts and designs of known hair devices. No known hair device provides the benefits and attributes of the present invention. Additionally, conventional hair devices do not suggest the present inventive combination of component elements arranged and configured as disclosed and claimed herein.

The present invention provides a hair device for securing hair in a fixed position or arrangement that includes a plastic coated wire strand for bending around hair. Additionally, the strands can be used as the arms or legs of a device that represents an animal or insect or some other character that may appeal to children. In this case, the arms or legs of the device are wrapped around the hair to secure the device in place or to hold the hair in a desired arrangement. Thus, the device provides a decoration or a decorative hair holder. The plastic surface of the plastic coated wire strand is less likely to become entangled within the hair because it simply bends around the hair to secure the hair into place, and does not contain any fastening devices. This eliminates the risk that unwanted hair may be caught between the fastening devices and broken-off. The strand or characters may be various colors to provide a decorative fashion accessory to the hair. The surface of the strand or characters may be smooth or may be adapted so that the surface of the plastic contains designs, or may contain indentures or raised areas to form designs and decorative surface areas on the plastic.

The dimensions and weight of the strand and both the body and the appendages of the character, as well as the total dimension and weight of the entire decorative hair device are important. The exact dimensions and weights of the decorative hair holding device depend in part on the type of hair that will be held. Use for this kind of product is novel to the market, however this product has been used, albeit in different weights and dimensions, as an action toy figure or for decorative detailing on packages. Both the action toy figures and the decorative detailing on packages are ineffective as a hair holding device as their dimensions and weights are not conducive for use in hair.

BRIEF DESCRIPTION OF THE DRAWINGS

The following detailed description of the preferred embodiments will be understood better if reference is made to the attached drawing, in which.

DETAILED DESCRIPTION OF THE PREFERRED EMBODIMENTS

The present invention provides a hair device that can be used to decorate hair or hold hair in place. The present invention also provides a decorative device that holds hair in place. The device can be a single plastic coated strand that can be wrapped around hair in various configurations. The device can also be configured to form a representation of a character, including animals. When configured to represent a character with arms or legs, the arms or legs can be wrapped around hair to secure the device in place in the hair for decorative purposes, or to hold the hair in a desired style. The device can have surface ornamentation or contours that serve a decorative function.

Figure 1:
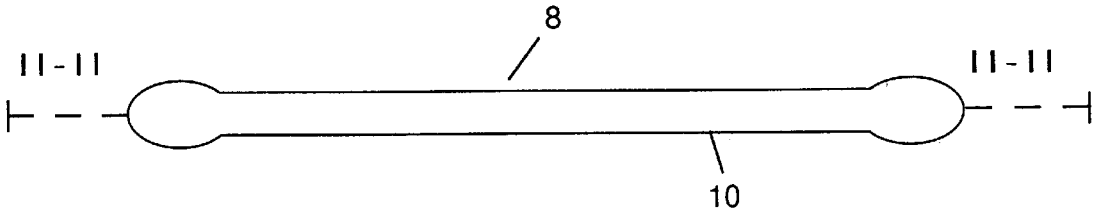
FIG. 1 is a perspective view of a single strand hair device provided by the present invention.
Figure 2:
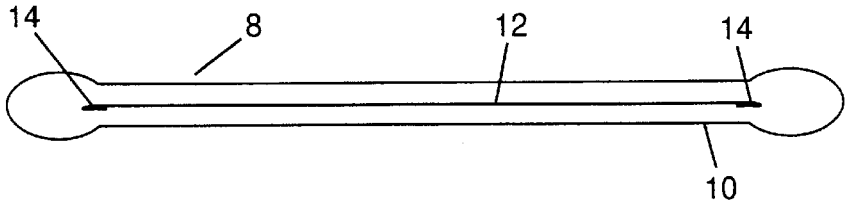
FIG. 2 is a sectional view of the strand shown in FIG. 1, taken along the line II—II.
Figure 3:
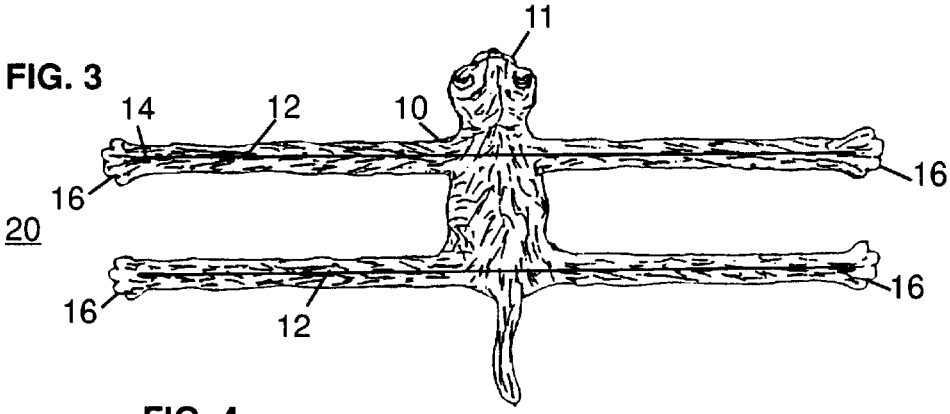
FIG. 3 is a top plan view of a hair device provided by the present invention in the form of a representation of a cat.
Figure 4:
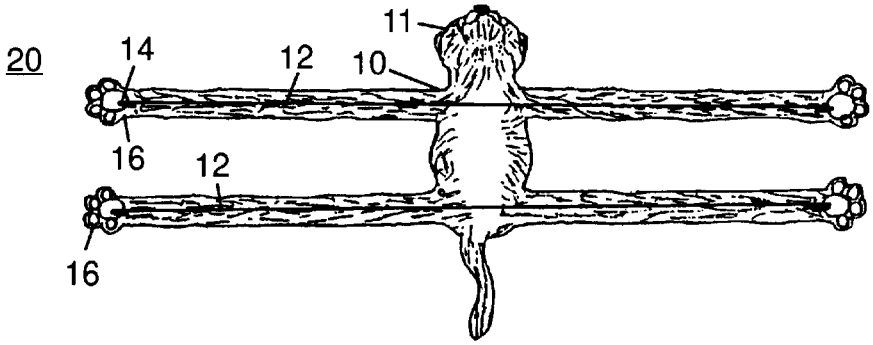
FIG. 4 is a bottom view of the hair device shown in FIG. 3.
Figure 5:
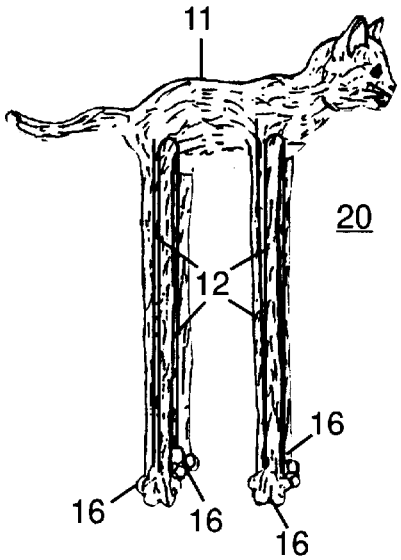
FIG. 5 is a side view of the hair device shown in FIG. 3 in which the front legs of the cat are positioned parallel to one another and the back legs of the cat are positioned parallel to one another.
Figure 6:
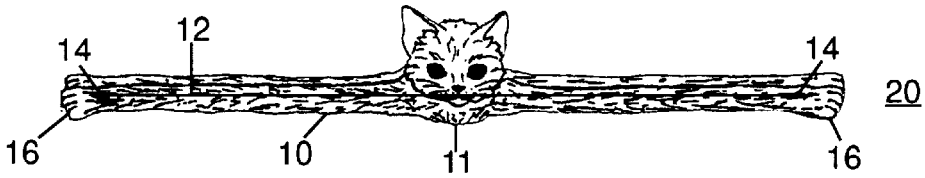
FIG. 6 is a front view of the hair device shown in FIG. 3.

FIGS. 1 and 2 show a hair styling strand, generally designated by numeral 8, that can be secured in the hair or that secures the hair in a fixed position or style. The hair device 8 includes a coating or body 10 and at least one wire 12 encased within body 10. FIGS. 1 and 2 show hair device 8 as a single strand, while FIGS. 3 through 13 show device 8 incorporated into a representation of a cat, a dog, a puppy and a teddy bear, strand 8 serving as the "arms" and "legs" of the various animals, in which case wire 12 may extend through the body of the character. However, the character may be constructed so that wire 12 is encased only in certain parts of the character.

Body 10 is formed of a flexible, malleable material, such as PVC plastic. Body 10 can be formed of a PVC plastic, or any other non-foam plastic, that has been injection molded. Body 10 encases at least one wire 12 of approximately 1 mm. in diameter. Body 10 has a thickness of approximately 5.5 mm. around wire 12. Body 10 may be formed of PVC plastic with a hardness of SORE A-70 and a density of 1.1840. The density and malleability of the material of which body 10 is formed facilitates the pliability of body 10, making it easier to wrap and secure hair device 8 around the hair. Body 10 must be thick enough so that wire 12 does not become exposed and protrude through body 10 after frequent use of hair device 8.

Body 10 extends approximately 5 mm from each end 14 of wire 12. When hair device 8 is used as a single strand, as shown in FIGS. 1 and 2, the recommended minimum length of body 10 is approximately 5 inches. When hair device 8 is incorporated into a representation of an animal, as shown in FIGS. 3 through 13, the minimum length of body 10 is approximately 4½ inches. Body 10 must be long enough so that it can be wrapped around a child's ponytail and hold the hair in place. The minimum length of body 10 as shown as a single strand is approximately ½ inch longer than the minimum length of body 10 as incorporated into a representation of an animal. This is because the animal representations have essentially two strands, i.e. the "arms" and "legs" of the various animals, which serve to hold the hair into place rather than just the single strand. Each end 14 of wire 12 is "folded back" on itself, and is not sharp or jagged, so there is no safety issue if wire 12 were to "poke" through body 10. If body 10 contains a center body area 11, (which represents the torso or body of a figure or animal), wire 12 can, but need not, extend through center body 11 into the appendages 16 of the character. Wire 12 may be comprised of wire material code number "19-lead wire" in which the surface of the wire is layered with zinc and the inside of the wire is a lower carbon. Wire which is of this weight, thickness and "stiffness" is preferred as it is light enough to remain in the hair and yet strong enough to hold the hair in a desired position while remaining flexible enough to be easily affixed around the hair.

The weight of hair device 8 may range from approximately ¼ounce to ½ ounce. At greater than ½ ounce, body 10 will be more apt not to stay in the hair, depending on hair type. A textured surface, however, tends to aid in the holding power of body 10. Therefore, if body 10 is smooth, at ½ ounce it will tend to fall out of the hair, but if body 10 is textured, at ½ ounce it is better able to stay in the hair. Therefore, the weight of hair device 8 may depend, at least in part on the surface type of body 10. The weight of hair device 8 will determine the weight of hair that can be effectively secured using only hair device 8. A person with hair that is thin may desire to use additional securing devices when wearing a heavier hair device 8.

Hair device 8 may be incorporated into a hair device that represents a character. For example, FIGS. 3 through 6 show a hair device 20 having a center body area 11 and four appendages 16. Hair device 20 forms a representation of a cat. Body area 11 may be approximately 1 ¼ inches long and ½ inch wide. Appendages 16 extend approximately 2 inches from the sides of center body area 11, so that the distance from the tip of one appendage 16 through and including center body area 11 to the tip of the opposite appendage 16 is approximately 4 ½ inches. Appendages 16 are approximately 3/16 of an inch in diameter. If device 20 includes more than one "set" of appendages 16, for example a set of front legs and a set of back legs, each set of appendages 16 is positioned approximately 5/16 of an inch apart from one another along center body area 11. FIGS. 3 through 6 show wire 12 extending through the body area 11. Depending on preference, body 11 need not encase a section of wire 12, in which case wire 12 would be encased only by appendages 16.

Figure 7A:
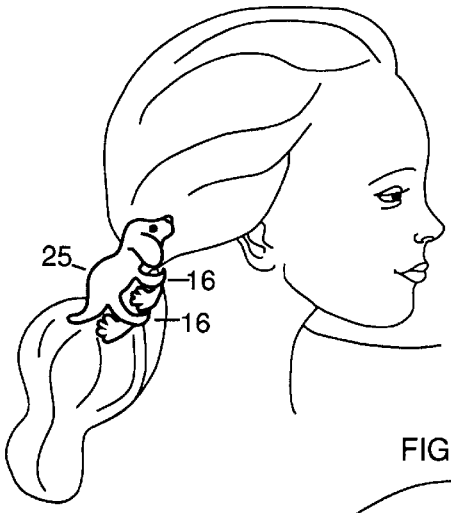
FIGS. 7A through 7E show a hair device provided by the present invention in the form of a representation of a dog shown secured in the hair of a person to form various hairstyles.
Figure 7B:
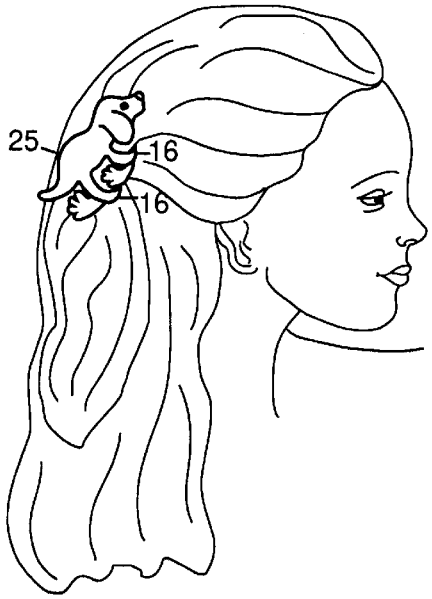
Figure 7C:
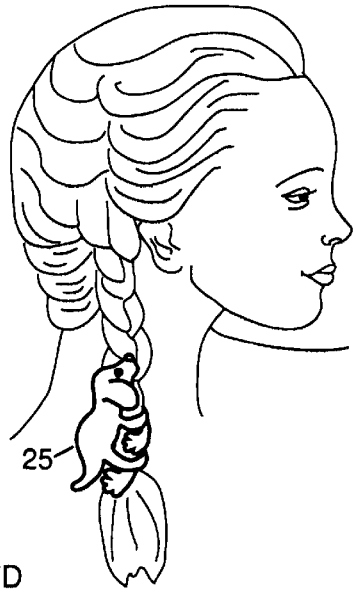
Figure 7D:
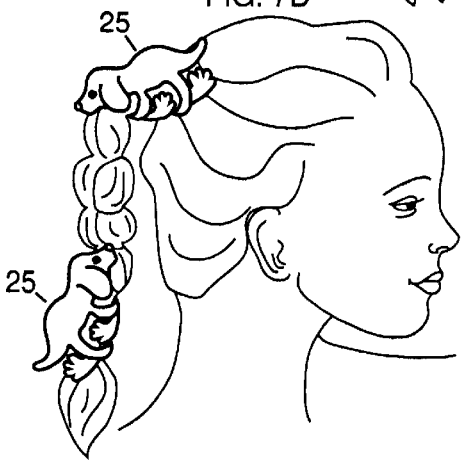
Figure 7E:
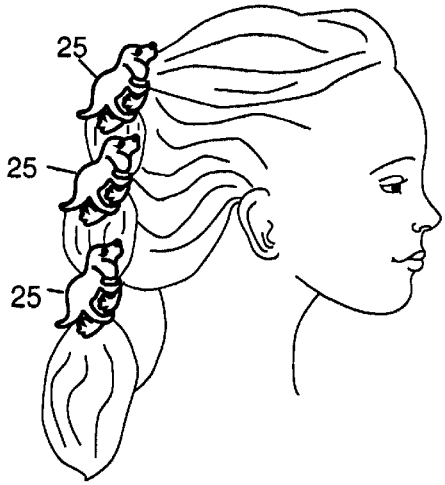

FIGS. 7A through 7E show a hair device 25 that is formed in a representation of a dog shown secured in the hair of a person to form various hairstyles. As shown in FIGS. 7D and 7E, more than one hair device 25 may be used at one time in the hair of a person. Appendages 16 are bent around the hair to secure hair device 25 in any orientation in the hair of a person. The dimensions of the various components of device 25 can be generally the same as those for hair device 20.

Figure 8:
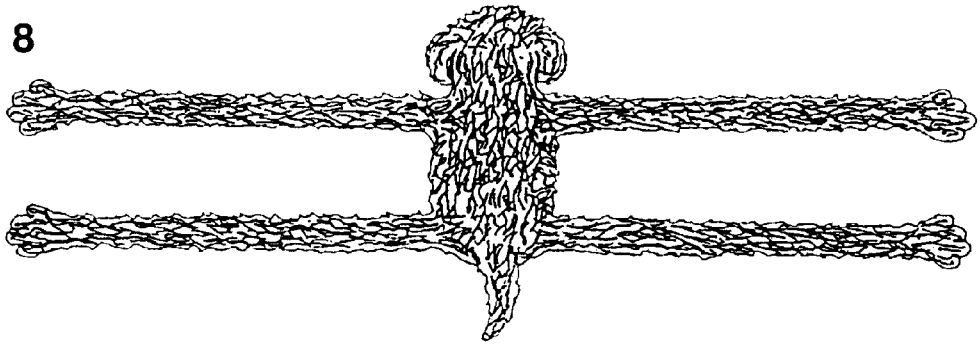
FIG. 8 is a top plan view of a hair device provided by the present invention in the form of a representation of a puppy.
Figure 9:
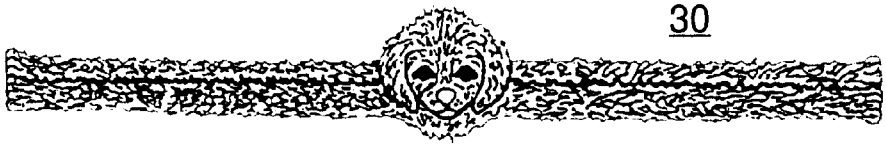
FIG. 9 is a front view of the hair device shown in FIG. 8.
Figure 10:
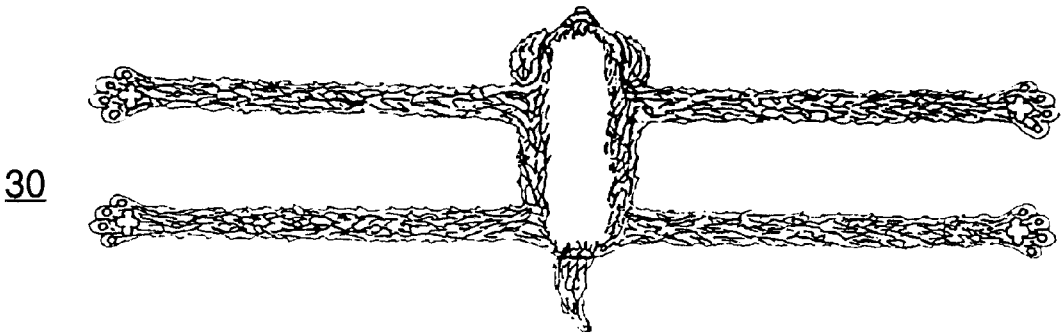
FIG. 10 is a bottom view of the hair device shown in FIG. 8.
Figure 11:
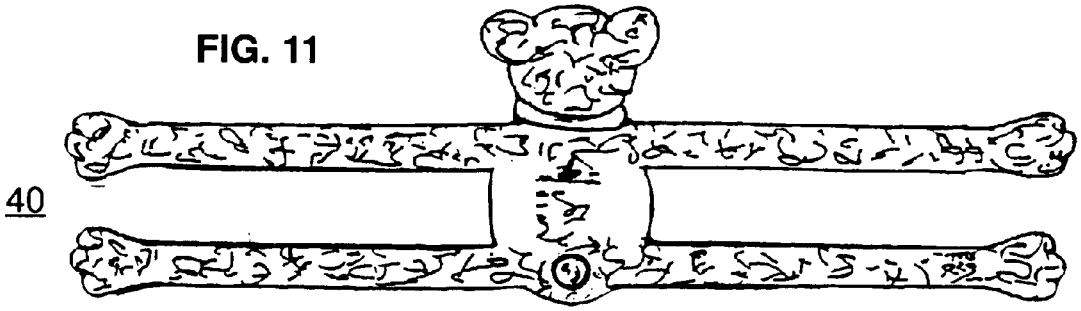
FIG. 11 is a top plan view of a hair device provided by the present invention in the form of a representation of a teddy bear.
Figure 12:
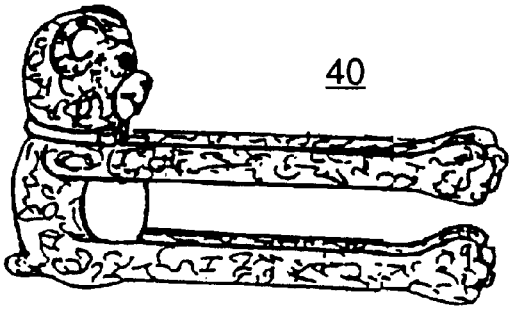
FIG. 12 is a side view of the hair device shown in FIG. 11 in which the front legs of the bear are positioned parallel to one another and the back legs of the bear are positioned parallel to one another.
Figure 13:
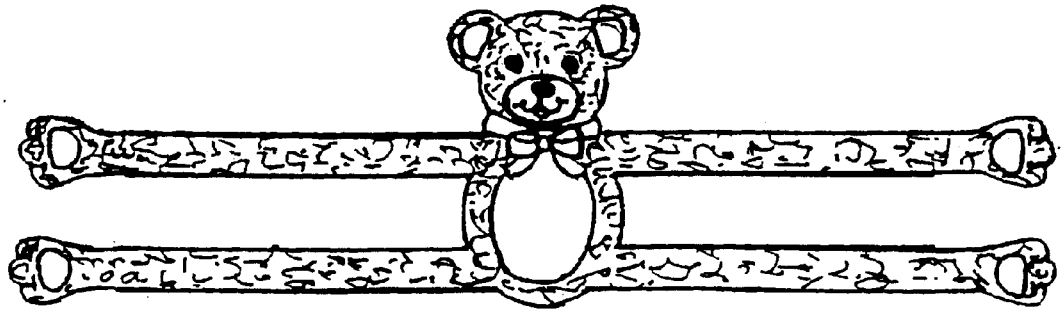
FIG. 13 is a bottom view of the hair device shown in FIG. 11.

FIGS. 8 through 10 show a hair device 30 that is formed in a representation of a puppy, and FIGS. 11 through 13 show a hair device 40 that is formed in a representation of a teddy bear. The dimensions of the various components of devices 30 and 40 can be generally the same as those for hair device 20. Like device 20, wire 12 can pass through the body areas of devices 30 and 40, can be limited to the arms and legs of devices 30 and 40, or can be limited to other sections or parts that will be bent when device 30 and 40 are placed in the hair.

Preferably, each of the devices shown in FIGS. 3 through 6 and 8 through 13 is approximately ½ ounce in weight.

It should be understood that the present invention can be formed into a variety of types of characters, and that only those parts or sections of the characters that will be bent when the device is lodged in the hair need to encase wire.

What is claimed is:

1. A device for holding hair comprising:

a main central body having two opposing sides, said main central body being formed of a non-foamed plastic;

at least two elongate appendages extending from each of said main central body, said appendages on one side disposed opposite those on the other side of said main central body, each appendage being formed of a non-foamed plastic and having a textured outer surface so as to securely grip the hair;

a bendable wire extending through each appendage so as to be encased therein;

wherein each appendage has a free end remote from said main central body, the distance from the free end of one appendage across said main central body to the free end of the opposite appendage being at least four and one half inches.

2. The device of claim 1, wherein said wire does not extend all the way to the free end of the appendage, the end of each wire being bend back upon itself so as not to pierce through the appendage.

3. The device of claim 1, wherein said wire had a diameter of at least 1 mm and each appendage had a thickness of at least 5.5 mm.

4. The device of claim 1 wherein the device weights between one-half ounce and one ounce.

* * * * *